US005833079A

United States Patent [19]

Roberts

[11] Patent Number: 5,833,079

[45] Date of Patent: Nov. 10, 1998

[54] SURFBOARD RACK

[76] Inventor: Ronald F. Roberts, 5050 Cass St. #15, San Diego, Calif. 92109

[21] Appl. No.: 835,384

[22] Filed: Apr. 7, 1997

[51] Int. Cl.[6] ..... A47F 5/00

[52] U.S. Cl. ..... 211/85.7; 211/87.01; 211/105.1; D6/552

[58] Field of Search ..... 211/87.01, 60.01, 211/85.7, 105.1, 70.6, 70.5, 18; D6/552

[56] References Cited

U.S. PATENT DOCUMENTS

| | | | |
|---|---|---|---|
| 4,271,997 | 6/1981 | Michael | 211/70.5 X |
| 4,878,586 | 11/1989 | Bancroft et al. | 211/87.01 X |
| 5,054,628 | 10/1991 | Allen | 211/18 X |
| 5,082,123 | 1/1992 | Lamb | 211/18 X |
| 5,141,116 | 8/1992 | Mojica | 211/87.01 X |
| 5,145,135 | 9/1992 | Thompson | 211/60.1 X |
| 5,642,820 | 7/1997 | Angeles | 211/18 X |

*Primary Examiner*—Robert W. Gibson, Jr.
*Attorney, Agent, or Firm*—Steins & Associates

[57] ABSTRACT

An Improved Surfboard Rack is disclosed. The disclosed surfboard rack comprises one or more rack units, to be attached to a substantially vertical surface and separated from each other by a preferred distance "X", depending upon the particular application for the rack. As disclosed the preferred rack unit comprises a base from which protrudes at least one strut member, and with said rack unit may further including a strut retaining portion, attached to the base, and from which each said strut member protrudes. Each disclosed strut member is preferrably canted upwardly from 4 to 20 degrees above horizontal. Also disclosed are strut members that may be permanently or removeably attached to said base and/or strut retaining portion. The disclosed strut members preferrably comprise a rigid core having a cap and a sheath of rope, foam rubber or other material thereover. The preferred base and strut retaining portion could be formed from wood, plastic or other substantially rigid material.

19 Claims, 6 Drawing Sheets

SURFBOARD RACK

BACKGROUND OF THE INVENTION

1. Field of the Invention

This invention relates generally to hanging storage devices and, more specifically to Improved Surfboard Rack.

2. Description of Related Art

Surfboards, snowboards, skateboards, wakeboards, water skis and snow skis are widely used by today's active outdoor athletes. Once even one of these items is acquired by someone, a storage problem generally results, especially in the case of surfboards. The surfboard is so big that it takes up a lot of room no matter where it is stored. It is common for a surfboard to be stored by standing it up in a garage, where a person can easily damage it by knocking it over or by hitting it with something like a lawnmower, or while working in the garage. What is needed, therefore, is a storage system for surfboards and the like that will keep them out of the way, both for space conservation and safety reasons.

There here have been many storage rack systems for surfboards, virtually since the surfboard was first invented. The typical rack system comprised a frame made from metal or wood that was unsightly, because these racks were designed for the garage where nobody would see them. The problem with an unsightly design is that it forces the user to keep the surfboard in the garage, where it could still be damaged while doing other work there. If the rack was aesthetically pleasing, the user would be encouraged to install it inside the house. In this way, the surfboard would not only be stored there, but also placed on display for visitors to see. Since the surfboard, etc. would be in the house, it would be much better protected from being hit by something else.

A problem with having an indoor storage (or even an outdoor one) is a lack of wall space from which to hang it. Particularly in the case of a surfboard, which can be very long, an entire wall might have to be dedicated to storing the board by conventional means. The typical prior surfboard rack stores the surfboard lying on its side—the problem with this is that quite a bit of vertical space is consumed by such a storage means. What is needed is a rack system that holds the surfboards, etc. very close to horizontal, and therefore has very little vertical space requirements, such that the rack can be pushed high up on the wall and out of the way. This would permit the surfboard to be well protected, but still not mandate the sacrifice of an entire wall. The new rack system should even be available with only a single storage position, such a system would be very short (vertically), and would be very conservative of wall space.

Another drawback of the prior rack systems is the rigidity of the storage struts. In order to hold a surfboard, the struts must be quite long, when there is no surfboard resting in the rack, the struts provide a hazardous protrusion into the room. It would be very helpful if the struts could be removed when not in use, so that persons walking past the rack would not be in danger of running into them. It would also be helpful if the struts were vertically adjustable to provide various different storage configurations with the same rack system.

Finally, the covering for struts of the prior rack systems has not been fully developed. Many times these struts are either left bare, or they have some soil of foam covering on them. If there is no covering, it could easily lead to damage to the surfboard, etc. while placing it on or removing it from the rack. The foam cushions are functional at the outset, but tend to have somewhat of a limited lifespan. After a fairly short time the foam can begin to degrade leaving bare spots on the strut that can damage the surfboard. What would be helpful is to have a cushion for the struts that is soft enough to protect the surfboard, etc., but also very durable. It would also be beneficial if this covering was aesthetically pleasing so that the user would be willing to install the rack system inside of his or her home as a display for the surfboard.

SUMMARY OF THE INVENTION

In light of the aforementioned problems associated with the prior devices, it is an object of the present invention to provide an Improved Surfboard Rack. The preferred surfboard rack comprises one or more rack units, to be attached to a substantially vertical surface and separated from each other by a preferred distance "X", depending upon the particular application for the rack. Each preferred rack unit comprises a base from which protrudes at least one strut member. The rack unit may further include a strut retaining, portion, attached to the base, and from which each strut member then protrudes. Each strut member is canted upwardly from 4 to 20 degrees above horizontal in order to securely retain the surfboard, etc. Each strut member may be permanently or removeably attached to the base and/or strut retaining portion. Each strut member may also include a rigid core having a cap and a sheath of rope, foam rubber or other material thereover. The preferred base and strut retaining portion could be formed from wood, plastic or other substantially rigid material.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description taken in connection with the accompanying drawings of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Improved Surfboard Rack.

Figure 1:
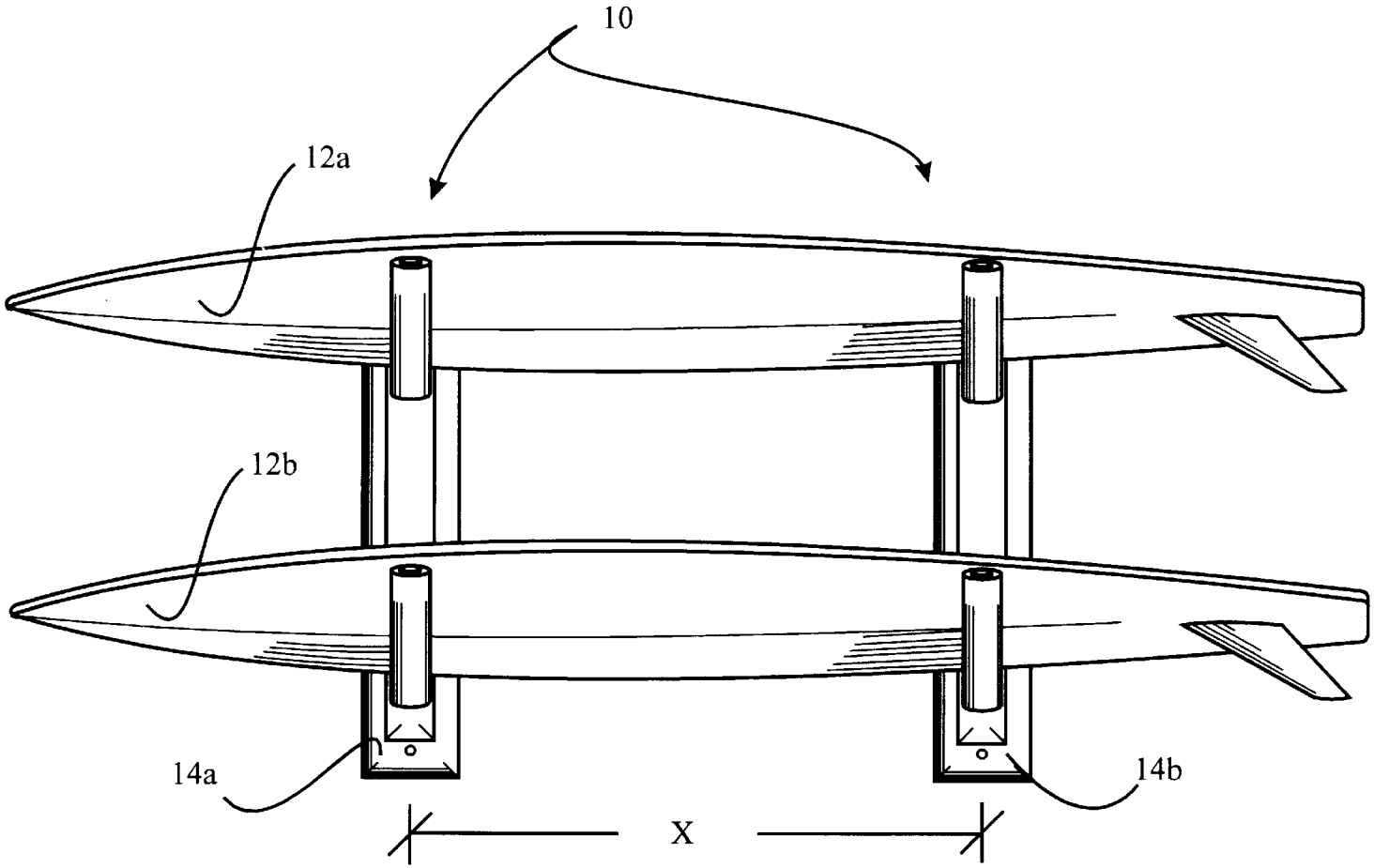
FIG. 1 is a front view of a preferred rack system of the present invention with surfboards resting thereon.

The present invention can best be understood by initial consideration of FIG. 1. FIG. 1 is a front view of a preferred rack system 10 of the present invention with surfboards 12*a* and 12*b* resting thereon. A typical rack system 10 of the present invention will comprise two rack units 14*a* and 14*b*. These rack units 14 are mountable to virtually any substantially vertical surface, such as a wall, the side of a vehicle, a free-standing frame, and others. The rack units 14 may be "permanently" anchored to the vertical surface, or they may be detachable, depending upon the desired application involved.

The rack units 14 are separated by a horizontal distance "X", which is chosen by the installer to provide the greatest flexibility to accept varying lengths of surfboards 12 or other items, such as skateboards, wakeboards, snowboards and others. It might also be desirable to have more than two rack units 14 in a particular rack system 10 such that even more storage flexibility might be attained. For example, another rack unit 14 might be installed between the two rack units 14*a* and 14*b* so both long items (e.g. surfboards) as well as short items (e.g. skateboards) can be stored on the same rack system 10.

Because the user determines the number of rack units 14 and the distance "X" between pairs of rack units 14, the present invention provides great versatility to capitalize on the space that the user has available to him or her. As such, the present invention does not mandate any pre-determined, rigidly-defined space for installation. The rack system 10 may be used to convert almost any available space into a storage and display space for surfboards, skateboards, wakeboards, snowboards, skis and the like. Furthermore, consideration of FIGS. 2 through 7 will demonstrate further utility of the present invention.

Figure 2:
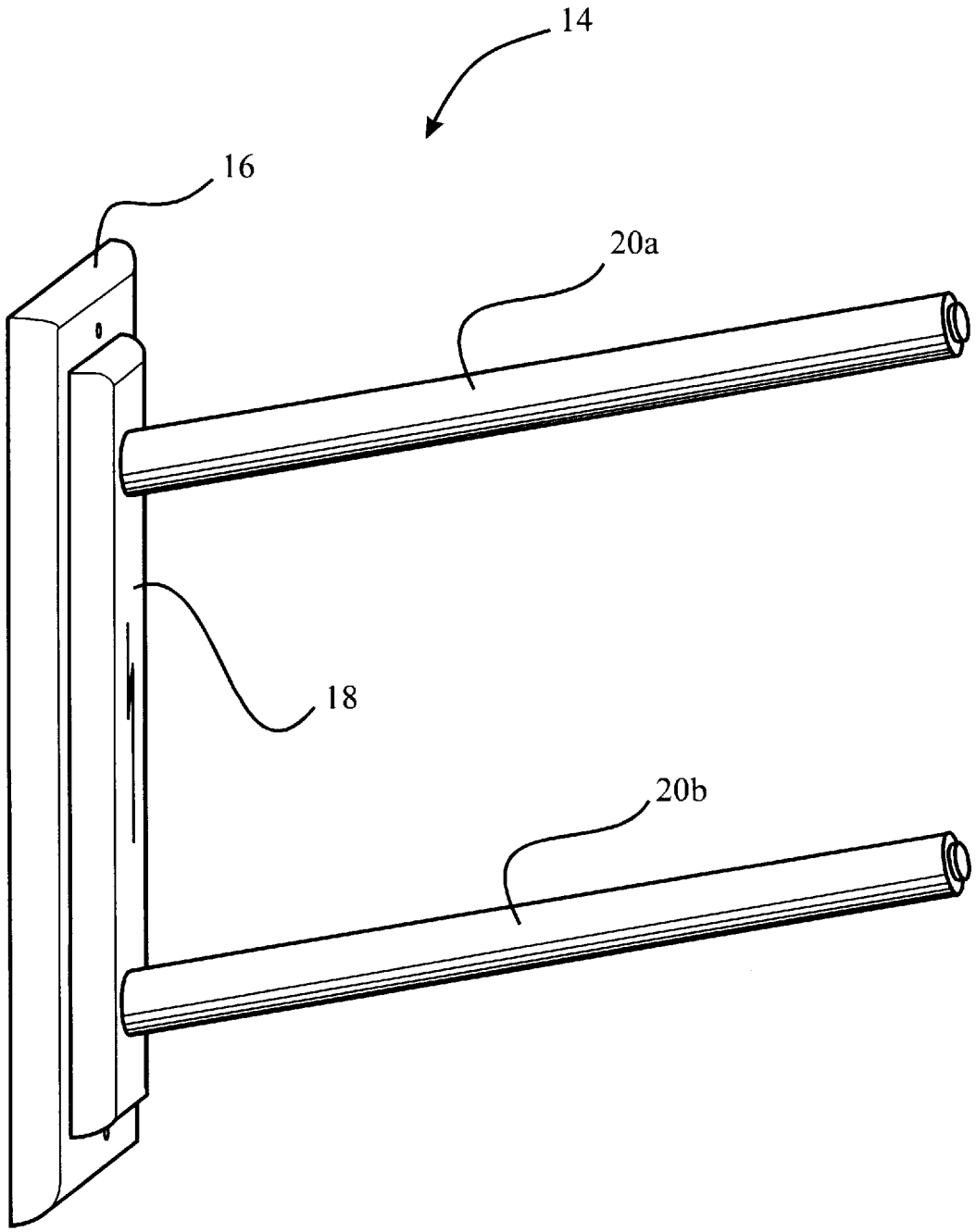
FIG. 2 is a perspective view of a preferred rack unit of the rack system of FIG. 1.

Now turning to FIG. 2, we might better appreciate the detail of the rack unit 14 itself. FIG. 2 is a perspective view of a preferred rack unit 14 of the rack system 10 of FIG. 1. The base 16 is attachable to a vertical surfaces and has at least one strut retaining portion 18 extending outwardly therefrom. The base 16 and strut retaining portion 18 might be made from a variety of well known materials, including wood, plastic, metal and others. The base 16 and strut retaining portion 18 may also be combined in a single piece of material, rather than two separate ones, depending upon the particular application for which the unit is destined.

Protruding outwardly from the strut retaining portion 18 is a pair of strut members 20*a* and 20*b*. These strut members 20 are ideally canted at an angle of 4 to 20 degrees above horizontal. The 4 to 20 degree cant of the strut members 20 is particularly useful aspect of this design it is the minimum amount necessary to provide the strength necessary to hold a long surfboard without requiring cantilevering or bracing on the bottom side of the strut member. Furthermore the slight cant will cause the surfboards and the like to rest firmly on the strut members 20, with very little vertical space being required, many times this is critical. Moreover, since so little vertical space is required, the rack system (see FIG. 1) can be mounted close to the ceiling, if desired, in which case the items stored thereon will be totally out of the way of occupants of the area.

The strut members 20 are rigid but soft to the touch, so that items will not be damaged when they are placed upon or removed from the rack unit 14. Other rack units 14 might include either fewer or more strut members 20, as desired, to provide the optimum storage utility.

One particularly unique aspect of the present invention is how the aesthetically pleasing design of the rack unit 14 provides utility. Because the rack unit 14 looks good, the user will desire to place it in a prominent position, such as within the home, where all can see the items that are stored there. This will provide the surfboards and the like with greater protection from the elements, environments theft, or tampering that the surfboard, etc. might be subjected to if it was stored in a utility area, such as in the garage or shed or outside the home.

Figure 3:
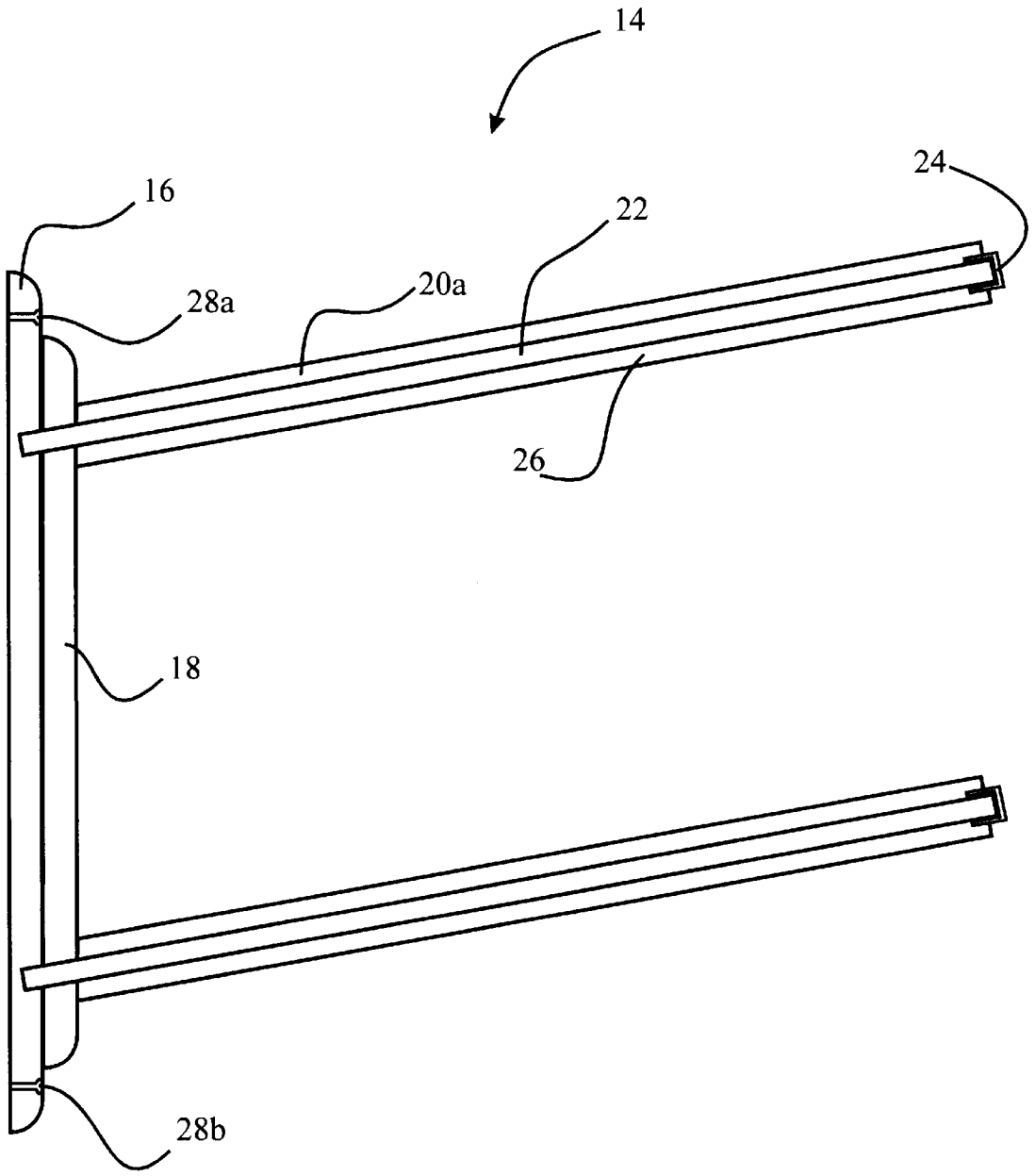
FIG. 3 is a cutaway side view of the preferred rack unit of FIG. 2.

FIG. 3 gives further detail of a preferred rack unit 14. FIG. 3 is a cutaway side view of the preferred rack unit 14 of FIG. 2. As can be seen, the strut member 20*a* comprises a core 22, with a cap 24 attached over its distal end. The core 20 may come in a variety of lightweight, strong and rigid materials, such as wood, metal tubing, plastic tubing and others that are well known in the art. The core 20 may also comprise a variety of cross-sections, including solid or hollow constructions of circular, rectangular, triangular or other shapes, depending upon the load-bearing and weight attributes that are desired. The cap 24 is preferably made from soft plastic, such that the end of the core 22 is not exposed to create a hazard to passersby, and where a hollow core 22 is employed, the cap 24 will prevent foreign objects from dropping into the center of the core 22. The core 22 is rigidly attached to the base 16 and/or strut retaining portion 18 by a variety of means including an interference fit, among others, as discussed below in connection with FIGS. 6 and 7.

Surrounding the core 22 is a sheath 26 for cushioning the strut member 20*a* to prevent damage to the surfboard, etc. The sheath 26 should fit snugly over substantially the entire length of the core 22 to prevent slipping or damage to the surfboard, etc., and may be constructed from foam rubber or even rope wrapped tightly around the core to provide a more durable and aesthetically pleasing rack unit 14.

The base 16 is further defined by a plurality of mounting apertures 28 passing through it. The base 16, therefore, is attachable to a vertical surface or frame, etc. by inserting anchoring means, such as screws or nails through the mounting apertures 28 and fixing them to the vertical surface or frame, etc. Various other configurations well known in the art may be used to mount the rack units 14 to a vertical surface, such as hooks, tracks, or screwing into the back face 30 of the base 16 from the vertical surface.

Figure 4:
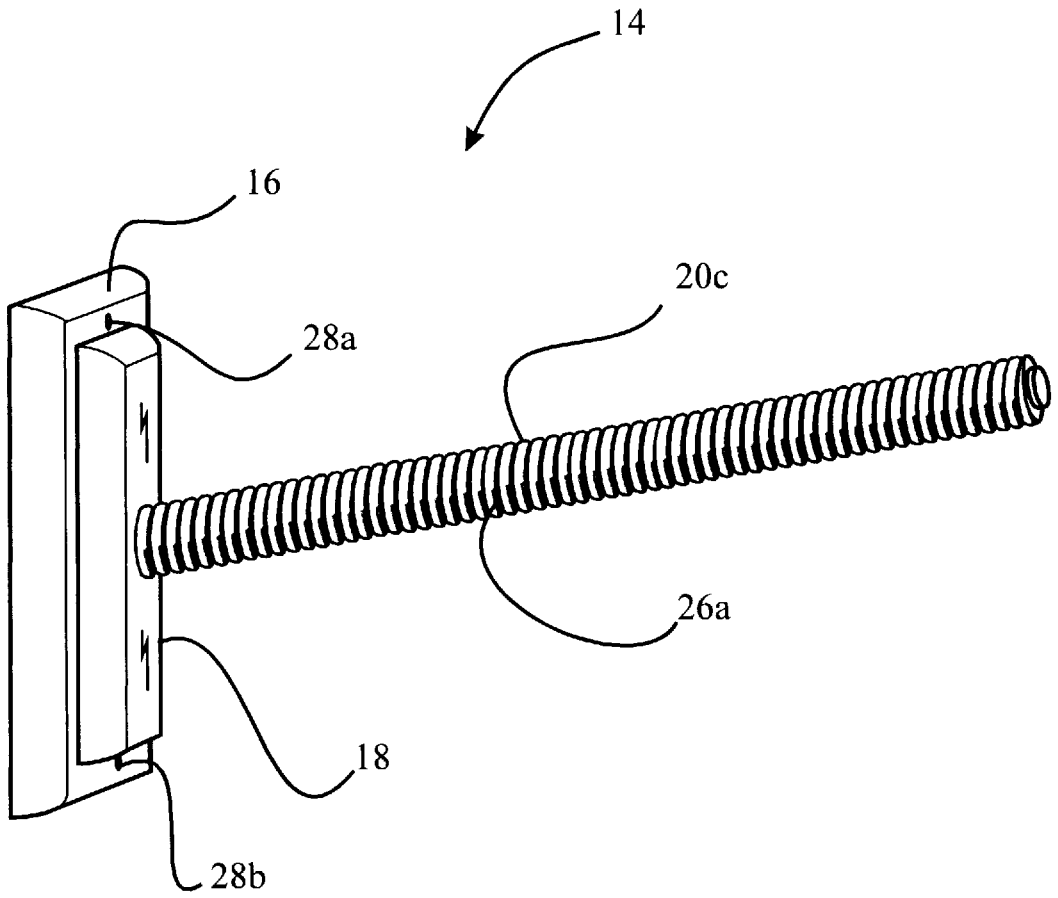
FIG. 4 is a side view of another preferred embodiment of the rack unit of the present invention having a rope sheath and a single strut member.

FIG. 4 provides another example of the rack unit 14 of the present invention. FIG. 4 is a side view of another preferred embodiment of the rack unit 14 of the present invention having a rope sheath 26*a* and a single strut member 20*c* . As can be seen, this alternative embodiment preferably comprises a base 16 having a plurality of mounting apertures 32 penetrating therethrough for anchoring the rack unit 14 to a vertical surface. Further, the rack unit 14 may comprise a strut retaining portion 18 and only a single strut member 20*c* at a 4 to 20 degree cant upward from horizontal. As can be seen, the strut member 20*c* may also have a rope sheath 26*a*. Using nylon, manila or other rope for the sheath 26*a* not only gives great aesthetic beauty, but also provides superior wear resistance and durability even when it is wetted and dried repeatedly, as may be the case when storing surfboards on the rack unit 14. The other elements of this alternative rack unit 14 are as described above in connection with FIGS. 1–3.

Figure 5:
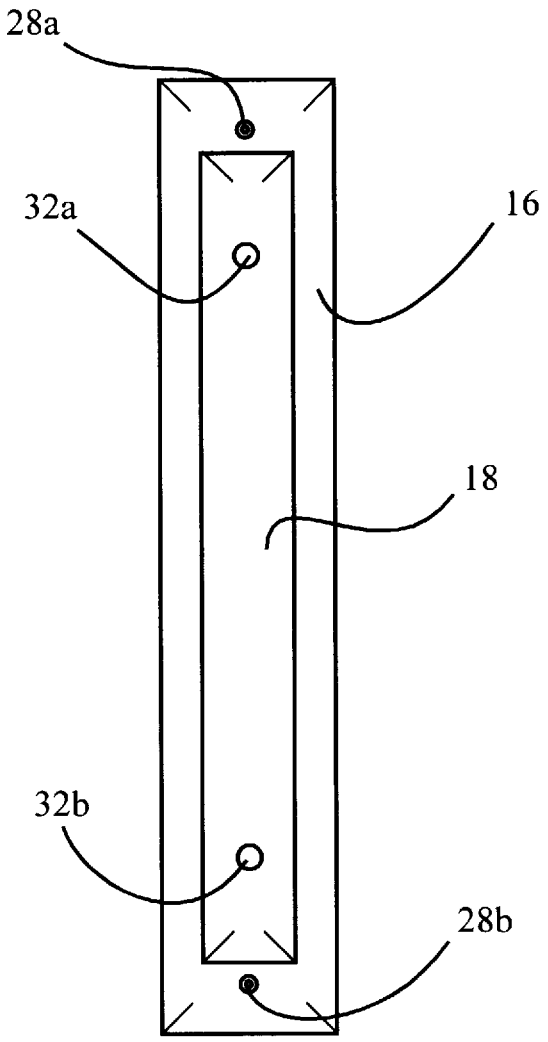
FIG. 5 is a front view of a base and strut retaining portion of the rack unit of FIG. 2.

Now considering FIG. 5, one may gain further understanding of how the strut members (see FIGS. 2–4) are attached to the base 16 and strut retaining portion 18. FIG. 5 is a front view of a base 16 and strut retaining portion 18 of the rack unit of FIG. 2. By alternating between FIGS. 3 and 5, one can see that the strut members 20 are insertible into the strut retaining apertures 32*a* and 32*b* . As is shown in FIGS. 3 and 5, the cores 22 may be slightly larger in diameter than the mounting apertures 32, such that when the cores 22 are pressed into the mounting apertures 32, an interference fit results, which will securely retain the strut members 20 without the need for additional hardware or gluing, etc. These strut retaining apertures 32 are ideally drilled through the entire strut retaining, portion 18 and partially, or even completely through the base 16 at an angle of 4 to 20 degrees above horizontal. The strut retaining apertures 32 will be shaped to accept whatever cross-section and size of core 22 is employed. as discussed in connection with the discussion under FIG. 3. As will be discussed below, other configurations for attaching the strut members 20 to the base 16 and strut retaining portion 18 are conceived of in the present invention.

Figure 6:
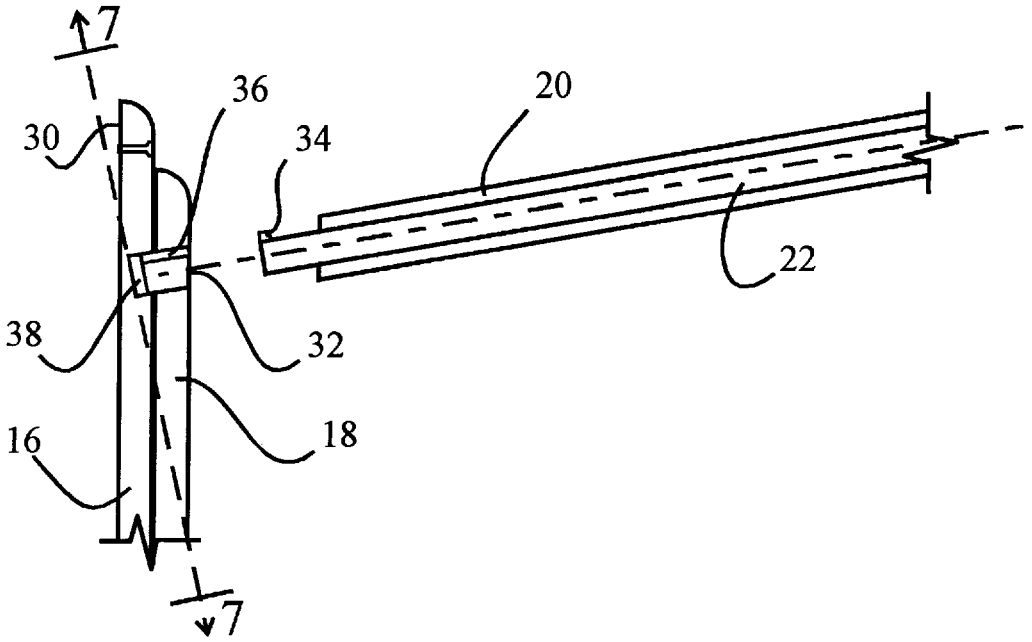
FIG. 6 is an exploded partial cutaway side view of a preferred rack unit showing a detachable strut member.

FIG. 6 shows one other means of attaching the strut member 20 to the base 16 and/or strut retaining portion 18. FIG. 6 is an exploded partial cutaway side view of a preferred rack unit 14 showing a detachable strut member 20. As can be seen, the core 22 is further defined by a key 34 formed at the end to be inserted into the strut retaining aperture 32. The strut retaining aperture 32 is further defined by a keyway 36 that is configured to accept the key 34. At the base of the strut retaining aperture 32, a locking channel 38 may be formed to receive the key 34 once the core 22 is fully inserted into the strut retaining aperture 32. In operation therefore, the core 22 and key 34 are inserted into the strut retaining aperture 32 and keyway 36 until the key 34 is far enough in to engage the locking channel 38, at which time the strut member 20 is twisted, such that the key 34 slides into the locking channel 38; the strut member 20 is then locked in place. To release and remove the strut member 20, the process need only be reversed.

With this design, the strut member 20 may be easily detached from the base 16 and strut retaining portion 18 when it is not in use. This provides great space efficiency and versatility, since if several mounting apertures 32 are disposed over the length of the base 16 and strut retaining portion 18, one could adjust the vertical distance between strut members 20 to accept many different sizes of items desired to be stored there. Furthermore, the strut member 20 could simply be removed when not in use, such that it is not taking up space and/or providing an obstacle for people to avoid when occupying the room where the rack unit 14 is mounted.

In another configuration, the strut retaining aperture 32 might pass fully through both the base 16 and the strut retaining portion 18, and have a small locking channel (not shown) formed on the back face 30 of the base 16, and no keyway 36. In this configuration, the core 22, without a sheath (see FIGS. 3 and 4), could be slid into the strut retaining aperture 32 from the back side 30 until the key 34 engages the alternative small locking channel (not shown). The sheath (see FIGS. 3 and 4) would then be installed over the core 22, which would prevent the strut member from being removed from the base 16 and strut retaining portion 18. This alternative means for mounting the strut member 20 might be desired where the base 16 and/or strut retaining portion 18 is made from injection-molded plastic, since otherwise the base 16 and/or strut retaining portion 18 might not be strong enough to provide a good interference fit with the core 22.

Figure 7:
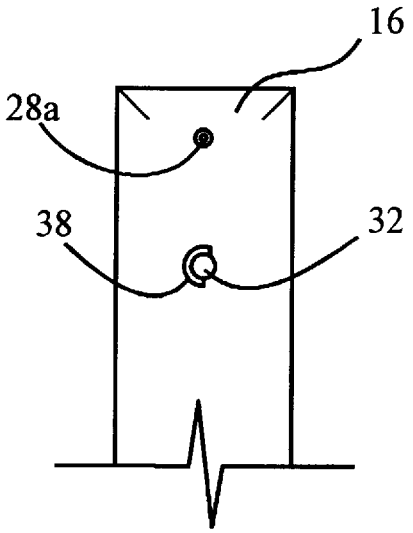
FIG. 7 is a partial cutaway front view of the base of FIG. 6 along the line A—A showing a locking channel.

FIG. 7 depicts the aforementioned locking design from another perspective. FIG. 7 is a partial cutaway front view of the base 16 of FIG. 6 along the line A—A showing a locking channel 38. As can be seen, the locking channel 38 is preferably a semi-circular groove at the base of the strut retaining aperture 32 that is configured to accept the key (see FIG. 6) when the core (see FIG. 6) is twisted.

Those skilled in the art will appreciate that various adaptations and modifications of the just-described preferred embodiment can be configured without departing from the scope and spirit of the invention. Therefore, it is to be understood that within the scope of the appended claims the invention may be practiced other than as specifically described herein.

What is claimed is:

1. A rack unit for storing surfboards, skateboards, wakeboards and the like, comprising:

a base;

a strut retaining portion extending from said base, said strut retaining portion defining a front face, said front face being substantially parallel to said base; and at least one strut member protruding from said strut retaining portion at a 4 to 20 degree angle from a plane that is perpendicular to said base.

2. The rack unit of claim 1, wherein said at least one strut member further comprises a sheath thereover for protecting said surfboard, skateboard, wakeboard and the like.

3. The rack unit of claim 2, wherein said base further comprises a back face and a front face and said strut retaining portion extends from said front face of said base.

4. The rack unit of claim 3, wherein:

said strut retaining portion is further defined by a back face and at least one strut retaining aperture disposed on, and flush with the surface of said front face;

each said at least one strut member is further defined by lower end and a distal end, and each said at least one strut member is attached to said strut retaining portion by inserting said lower end of each of said at least one strut member into one said strut retaining aperture.

5. The rack unit of claim 4, wherein said base and said strut retaining portion are substantially rectangular and substantially rigid.

6. The rack unit of claim 5, wherein the rack is attachable to a substantially vertical surface, and:

said base is further defined by a plurality of mounting apertures disposed on said front face of said base and extending therethrough to penetrate said back face;

said base is attached to the substantially vertical surface by inserting anchoring means through each of said mounting apertures and attaching said anchoring means to the vertical surface; and each said strut member is detachable from said base and said strut retaining portion.

7. The rack unit of claim 6, wherein said base and said strut retaining portion are made from wood.

8. The rack unit of claim 7, wherein said sheath comprises foam rubber-like material.

9. The rack unit of claim 7, wherein said sheath comprises rope.

10. A rack system for hanging surfboards, skateboards, wakeboards and the like from a substantially vertical surface, comprising at least a pair of rack units mounted parallel to one another and in horizontal alignment, each said storage rack unit comprising a base, a strut retaining portion extending from said base, said strut retaining portion defining a front face, said front face being substantially parallel to said base, and at least one strut member protruding from said strut retaining portion at about 7 degrees from perpendicular to said base.

11. The rack system of claim 10, wherein each said base is made substantially entirely from wood, plastic or metal.

12. The rack system of claim 11, wherein each said strut member comprises an elongated, straight, substantially rigid core and a protective sheath disposed thereover.

13. The rack system of claim 12, wherein:

each said strut retaining portion is further defined by a front face and a back face and at least one strut retaining aperture disposed on, and flush with the surface of each said front face; and each said at least one strut member is further defined by lower end and a distal end, and each said at least one strut member is attached to each said strut retaining portion by inserting each said lower end of each of said at least one strut member into one said strut retaining aperture.

14. A rack system for hanging surfboards, skateboards, wakeboards and the like from a wall, comprising a pair of rack units, attached to said wall in substantially parallel and substantially horizontal alignment and spaced horizontally from one another by a distance adequate to provide stability to each surfboard, skateboard, wakeboard and the like is rested thereon, each said rack unit comprising:

a rectangular base having substantially parallel front and back faces;

a rectangular strut retaining portion having a front face substantially parallel to said base front face, extending from said base; and at least one strut member protruding from said strut retaining portion at a 4 to 70 degree angle from a plane that is perpendicular to said base, each said at least one strut member further comprising an elongated, rigid, substantially straight core having a substantially circular cross-section and a cushioned sheath disposed over said core.

15. The rack system of claim 14, wherein:

each said base further comprises a back face and a front face;

each said strut retaining portion is further defined by a front face, and a back face and at least one strut retaining aperture disposed on, and flush with the surface of said front face; and each said at least one strut member is further defined by lower end and a distal end, and each said at least one strut member is attached to said strut retaining portions by inserting said lower end of each of said at least one strut member into one said strut retaining aperture.

16. The rack system of claim 15, wherein:

each said base is further defined by a plurality of mounting apertures disposed on said front face of said base and extending therethrough to penetrate said back face; and each said rack unit further comprises anchoring means for anchoring each said base to the wall, said anchoring means inserted through each said mounting apertures and attached to the wall.

17. The rack unit of claim 4, wherein:

each said lower end is further defined by a key-like protrusion; and each said strut retaining aperture further includes a channel for accepting said key-like protrusion, whereby said key-like protrusion can be engaged and disengaged from said channel by twisting said at least one strut member.

18. The rack system of claim 8, wherein:

each said lower end is further defined by a key-like protrusion; and each said strut retaining aperture further includes a channel for accepting said key-like protrusion, whereby said key-like protrusion can be engaged and disengaged from said channel by twisting said at least one strut member.

19. The rack system of claim 16, wherein:

each said lower end is further defined by a key-like protrusion; and each said strut retaining aperture further includes a channel for accepting said key-like protrusion, whereby said key-like protrusion can be engaged and disengaged from said channel by twisting said at least one strut member.

* * * * *